United States Patent [19]

Jenkins et al.

[11] 3,969,731

[45] July 13, 1976

[54] MESH ARTICLES PARTICULARLY FOR USE AS REFLECTORS OF RADIO WAVES

[75] Inventors: Robert K. Jenkins, Huntington Beach; Leon B. Keller, Palos Verdes Peninsula; John H. Cover, Jr., Woodland Hills, all of Calif.

[73] Assignee: Hughes Aircraft Company, Culver City, Calif.

[22] Filed: Feb. 19, 1974

[21] Appl. No.: 443,645

Related U.S. Application Data

[63] Continuation of Ser. No. 9,132, Feb. 11, 1970, abandoned, which is a continuation of Ser. No. 590,571, Oct. 31, 1966, abandoned.

[52] U.S. Cl. ..... 343/840; 343/897; 343/915

[51] Int. Cl.[2] ..... H01Q 15/20

[58] Field of Search ..... 343/840, 915, 897

[56] References Cited

UNITED STATES PATENTS

| | | | |
|---|---|---|---|
| 2,750,321 | 6/1956 | Koppelman | 343/873 |
| 3,224,007 | 12/1965 | Mathis | 343/915 |
| 3,354,458 | 11/1967 | Rottmayer | 343/915 |

FOREIGN PATENTS OR APPLICATIONS

| | | | |
|---|---|---|---|
| 758,090 | 9/1956 | United Kingdom | 343/915 |

*Primary Examiner*—Eli Lieberman
*Attorney, Agent, or Firm*—Lewis B. Sternfels; W. H. MacAllister

[57] ABSTRACT

A mesh article, such as a reflector for radio frequencies, comprises glassy base fibers of high tensile strength, low elongation properties and low coefficient of expansion, the fibers being coated with a thin layer of metal. In a typical embodiment, the fibers are quartz coated with aluminum. The fibers are not interwoven and are bonded together at their intersections and to a peripheral ring support. These articles are lightweight, flexible and foldable and possess a "shape memory."

10 Claims, 3 Drawing Figures

MESH ARTICLES PARTICULARLY FOR USE AS REFLECTORS OF RADIO WAVES

BACKGROUND OF THE INVENTION

This is a continuation of application Ser. No. 9,132 filed Feb. 11, 1970, now abandoned, which in turn is a continuation of application Ser. No. 590,571 filed Oct. 31, 1966, now abandoned.

This invention relates to electrically conductive mesh articles characterized by being flexible yet thermally stable. More particularly, but not necessarily exclusively, the invention relates to radio wave reflective articles and materials in mesh form which are electrically conductive and of exceptional light weight, flexibility, and dimensional and thermal stability. Such articles and materials may be readily formed and maintained in extremely accurate shapes.

The articles and materials of the present invention are especially useful for lightweight radar antennas and particularly where such antennas are to be used in space as on space satellites or celestial bodies (i.e., the moon). Heretofore it has been customary to utilize solid metal surfaces for the reflection of radio waves in such applications. Such solid reflective articles have been produced from sheet metal, metal foil, or metal-coated substrates. Such space applications require radio wave reflectors to possess many diverse properties which often are incongruous and usually not achievable in solid structures. Thus, large size and low weight are usually required as well as flexibility and dimensional and structural rigidity, especially to environmental and maneuvering conditions. At the same time, the ability to be packaged in a small volume, as during transit to a space station, and the ability to be deployed thereat into the correct shape, are desirable features. Heretofore some of these properties have been sought in approaches utilizing umbrella-like structures consisting of spokes and mesh, metallized polymeric films reinforced with plastic or foam capable of being hardened in space, or petaloid structures made of a large number of electroformed metal (i.e., nickel) segments which are mechanically unfurled. It will be appreciated that these various constructions have possessed disadvantages such as high weight per unit area of reflective surface (i.e., 0.1 to 0.3 lb./sq. ft. of deployed surface), mechanical complexity, poor dimensional accuracy, and low reliability. Perforated or expanded metal reflectors, or woven and/or welded wire grids have also been used with a sacrifice in lightness, flexibility, and foldability. In contrast, the conductive mesh articles and materials of the invention are lighter by several orders of magnitude with respect to comparable prior art constructions and exhibit flexibility and foldability prior to deployment into shape as well as being more dimensionally precise. Constructions achieved according to the present invention, for example, weigh from 0.001 to 0.003 lb./sq. ft. of deployed surface. In the case of a 120-foot diameter paraboloid design made according to the invention, deviation from the true paraboloid was estimated to be $\pm 0.125$ inch compared to a predicted deviation of $\pm 1.0$ to $\pm 3.0$ inch for such paraboloids fabricated according to the prior art. It is also possible to make articles according to the invention which possess a smooth, doubly curved shape without gaps, laps, seams, or discontinuities.

It is therefore an object of the present invention to provide an improved electrically conductive mesh article of prescribed shape and which is dimensionally accurate and stable.

Another object of the invention is to provide an improved mesh article of prescribed shape suitable for use as a reflector of radio waves.

Another object of the invention is to provide an improved electrically conductive mesh article of prescribed shape, which is dimensionally accurate and stable, of light weight, which is flexible, and capable of being folded into a small volume prior to deployment into the prescribed shape.

Still another object of the invention is to provide an improved mesh reflector for radio waves wherein the mesh-forming elements and spaces may be precisely established and maintained.

These and other objects and advantages of the invention are realized by providing mesh-forming material or elements comprising glassy base fibers of high tensile strength, low elongation properties, and low coefficient of expansion which fibers are coated with a thin layer of metal. By forming such fibers of appropriate diameters and by maintaining the prescribed spacing therebetween when formed into a mesh article, an excellent reflector of radio waves for a particular frequency thereof may be provided. Such mesh articles are lightweight, flexible and foldable. The mesh configuration is achieved by bonding the fibers together at their intersections. It was discovered that such mesh articles appear to possess what may be called a "shape memory" that aids considerably in deployment of the article to the desired shape after it has been folded.

The invention will be described in greater detail by reference to the drawings in which.

Figure 1:
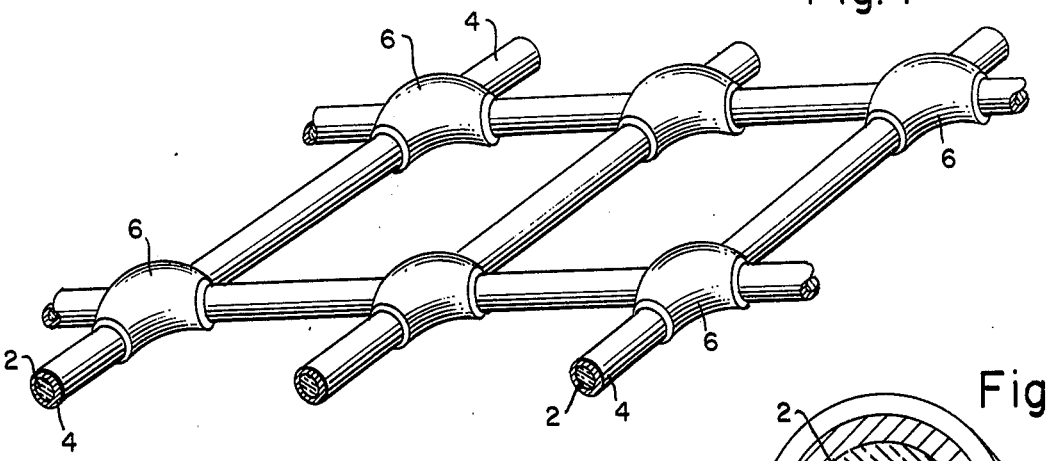
FIG. 1 is a perspective view partly in section of a mesh structure according to the invention.
Figure 2:
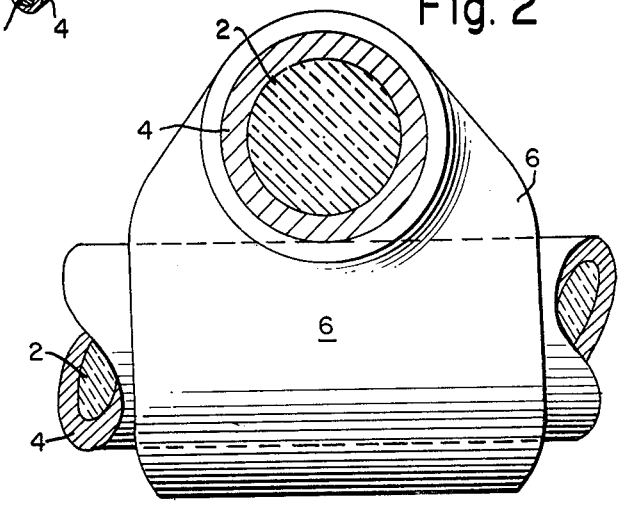
FIG. 2 is an elevational view partly in section of a pair of intersecting fibers showing the same in greater detail.

Mesh articles according to the invention are formed by threads or fibers having high tensile strength, low elongation, and a low coefficient of expansion. Suitable fibers are available from inorganic materials such as fused quartz, other various glasses formed of fused metal oxides and/or metal silicates which may be drawn from the molten state into continuous fibers. Such fibers are referred to hereinafter as "glassy". The term "quartz" as used herein refers to the material of chemical formula $SiO_2$, usually found in crystalline form in nature as well as to noncrystalline or vitreous materials. These fibers 2 are coated with a thin layer 4 of metal and retain their desirable physical properties without degradation and also become electrically conductive. The metal usually employed to coat the quartz fibers is typically aluminum and coating is achieved by freezing molten aluminum on the surface of the fiber. Quartz fiber, meaning silicon dioxide formed into fibers, is a preferred fiber material because of its exceptionally low coefficient of thermal expansion and other excellent properties.

Such metal-coated fibers are stretched over a mandrel or surface having the desired shape so as to form a mesh structure with the desired mesh spacings and are bonded together at their intersections, as shown in the drawing, with an adhesive 6 preferably of the epoxide type although other elastomeric and/or glassy adhesives may also be employed. After curing or hardening the adhesive, a stable mesh structure is obtained which is flexible and foldable.

In a typical example, a mesh structure for use as a reflector of incident energy at a frequency of 1500 megacycles was fabricated using quartz fibers coated with aluminum and having a composite diameter of 6.5 mils. A square mesh pattern with a spacing of approximately ½ inch was formed. After curing the adhesive, a stable mesh structure was obtained having a weight of 0.002 lb./ft$^2$ which reflected better than 90% of the incident energy. A similar structure was fabricated employing such quartz fibers having a diameter of 2.5 mil. With a mesh spacing of from ¼ to ⅛ inch better than 90% of incident energy having a frequency of 5000 megacycles was reflected.

In general, the fiber spacing is predetermined by the frequency of the radio waves to be reflected. The following table demonstrates the approximate relationship between fiber spacing and frequency to achieve better than 95% reflectivity of the incident energy:

| Band | Frequency Wavelength, λ Hz | Inches | λ/20, inches | Fibers/Inch |
|---|---|---|---|---|
| VHF | 300 | 39.4 | 2.5 | |
| U | 1200 | 9.8 | 0.6 | 2 |
| S | 3300 | 3.5 | 0.22 | 5 |
| C | 5000 | 2.3 | 0.14 | 7 |
| | 7000 | 1.67 | 0.104 | 9.6 |
| X | 8000 | | 0.093 | 11 |
| | 9000 | 1.3 | 0.082 | 12 |

As noted previously, a material suitable for a mesh-type reflector of radio waves, especially for use in outer space, should be lightweight, strong, and electrically conductive. While fused quartz fibers have remarkably high tensile properties, having strengths of 800,000 psi when tested in air and 1,200,000 psi when tested in vacuum, these fibers on first consideration appear to have several serious drawbacks for use as a reflector of radio waves. For one thing, the strength of quartz fibers degrades catastrophically when abraded or subjected to chemical attack — mere exposure to atmospheric moisture causes a large reduction in strength. In providing such quartz fibers with a metallic coating to render them suitable for reinforcing massive aluminum metal, it was discovered that the fibers retained to a substantial degree their attractive initial physical properties and quickly regained their strength upon drying after being exposed to moisture. This was found to be particularly true when a metal coating of aluminum is employed which equals in cross-sectional area that of the quartz fiber itself and this is a preferred form for the metallized quartz fibers of the invention. In general, the requisite thickness of metal is about 0.4 times the radius of the quartz fiber yielding an equal area of metal to quartz in cross section.

Another undesirable characteristic of quartz fibers was their tendency to break in flexure at any microscopic flaw in their surface, particularly as might arise when abraded as during folding. It was found, however, that fibers when metal-coated were not significantly degraded by flexure which thus makes it feasible to fold the mesh structures of the invention into small volume packs for later deployment in outer space.

Among the other outstanding physical properties of quartz fibers which makes them exceptionally useful as mesh structures in space applications are its elastic moduli, low coefficient of thermal expansion, and low density. The elastic modulus (rigidity modulus $= 4.5 \times 10^6$; Young's modulus $= 30 \times 10^6$) approach that of steel. Fiber elongations resulting from electrostatic pressures and space environmental loads have been found to be negligible. Because of their exceptional flexibility, these fibers can be folded to extremely small radii of curvature without breaking or kinking. The high elastic modulus together with the low coefficient of thermal expansion ($0.5 \times 10^{-6}$) make it possible to obtain the very high precision necessary in the fabrication of mesh structures over a high tolerance mandrel. The low density of quartz (2.6 gm/cc) which is approximately equal to that of aluminum enhances the low weight of the over-all structure.

When employed as a reflector for radio waves, the high porosity (95% at 8 $GH_z$) of the mesh reduces solar shading problems to a minimum and further minimizes thermal distortions of the whole antenna and spacecraft structural system. Likewise the low temperature coefficient of the quartz material essentially eliminates the thermal distortion problem in the reflecting surface itself. At the same time, the high porosity of the mesh permits the reflecting surface to be uniformly illuminated with minimum thermal gradients.

Figure 3:
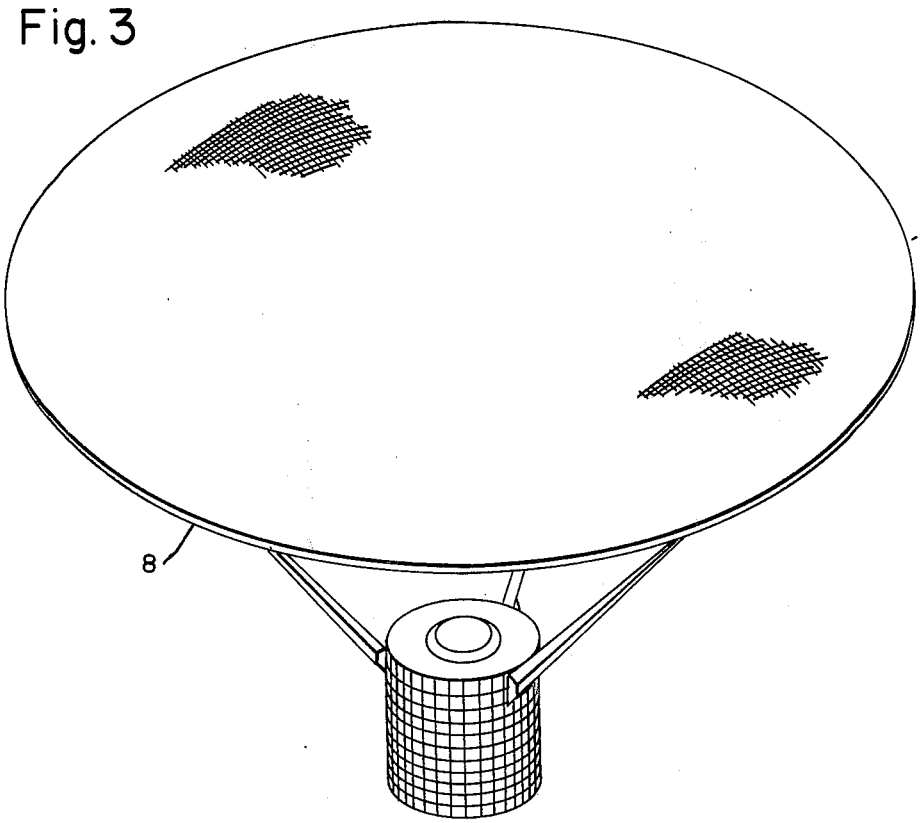
FIG. 3 is a perspective view of mesh radio wave reflector according to the invention.

As shown in FIG. 3, a typical antenna structure according to the invention is a paraboloid mesh, the mesh being formed in the same operation as the paraboloid, yielding a smooth curved shape which is dimensionally stable and maintains its parabolic contour. Such an antenna mesh is essentially a network of fibers precisely spaced on a male mandrel of exact paraboloidal contour. The fiber spacing is predetermined by the frequency of the RF energy to be reflected. The interweaving of fibers, as in normal cloth or screen, is preferably avoided in the design of the mesh for the following reasons. The weaving of fibers causes a bending of the fibers at the cross-over points and the fiber is no longer a straight structural member able to support tensile loads without undue strain. Secondly, the interweaving of fibers complicates the fabrication of large meshes to an extreme degree because it requires weaving machinery to control the movement of each fiber as additional fibers are added to the pattern. The significance of this complication will be appreciated when it is considered that an antenna having a diameter of 120 feet and 10 fibers per inch will require a total of 28,800 fibers having a total length of 660 miles.

According to the invention, the individual fibers are held in position and in correct relation to each other by bonding the fibers to each other at cross-over points or intersections. In this way, structural continuity is maintained throughout the mesh without deforming or bending the fibers. The fibers are laid individually in place in a predetermined winding pattern on a male mandrel of precise shape. Each fiber is bonded to a peripheral ring and, after the entire mesh is in place, the fiber intersections are bonded. After removal of the mesh and ring assembly from the mandrel, it may be folded and packaged. A convenient way to fabricate the mesh structures of the invention is to machine grooves in the mandrel surface for retaining the fibers therein during assembly. These grooves may be V-shaped and only deep enough to accommodate the fiber. Small holes may be provided at the intersections of the grooves in order to free the fiber from the mandrel to permit unimpeded bonding.

Another method for fabricating a mesh structure for patterns other than geodesic is to spray a pressure-sensitive adhesive on the mandrel. Fibers laid on the mandrel will therefore remain in position during bonding. After completion of the mesh, the adhesive film may be chemically dissolved and the mesh removed from the mandrel. Vinyl or siliconebased adhesives are satisfactory for this technique.

In applying the adhesive or bonding agent to the cross-over points of the fibers, it has been found that the adhesive wets and wicks between the intersecting fibers to form a small bead. The adhesive bead cures to form a structural bond having a shear strength of from 2000 to 3000 psi. It is generally preferable, especially where the fibers are closely spaced and a mandrel without grooves is employed to place the first layer of fibers on the mandrel and bond each intersection of each fiber as the second and succeeding intersecting fibers are laid in place. This may be accomplished by mounting an adhesive applicator on the fiber feeding mechanism to precede the fiber and apply the adhesive thereto as it is fed onto the mandrel. After the first layer of fibers is complete, the adhesive applicator is adjusted in height to deposit a small amount of adhesive on each fiber it passes over. The fiber being placed on the mandrel directly behind the adhesive applicator therefore encounters adhesive at each intersection.

An alternate and less complex procedure is to spray or brush the entire mesh with a dilute adhesive followed immediately with a dry brushing or blotting operation to remove excess adhesive except that which is wicked between intersecting fibers. While a thin resin coating might adhere to the upper surface of the fibers, the additional weight and stiffness added to the mesh would be negligible.

The selection of a suitable adhesive for the bonding of the fibers is based primarily on ease of application and good wetting properties. A satisfactory adhesive giving excellent results is an amine-cured epoxy system. The joints resulting are formed by a resin bead approximately 1/32 inch in diameter. Typical adhesive for the purposes of the present invention comprises 100 parts of an epoxy prepolymer cross-linked by ten parts of diethylene triamine. The useful life of this adhesive system is 30 to 60 minutes at room temperature. Usually the adhesive system is prepared in 100 gram batches and blended with 1% of a carbon black slurry to facilitate observability of the resin and the bead formed thereof. The epoxy resin cures to a hard glassy polymer in approximately three hours at room temperature. Flexible or rigid adhesive systems may be employed. Generally, with close fiber spacing of ten per inch or more, it may be necessary to employ a low modulus, high elongation elastomeric adhesive to provide flexibility in the final mesh. Elastomeric properties may be imparted to epoxy adhesives by modifying them with polyamines. In addition, many silicone and polyurethane systems have the required properties.

One of the novel and advantageous features of a mesh article according to the invention is the fact that the article may be formed into a configuration having at least one axis of curvature and still be of one-piece or unitary structure. Previously, doubly-curved mesh articles, for example, had to be formed from a plurality of pieces which were joined together. The mesh articles of the invention are capable of being formed into such doublycurved configurations without discontinuities and hence are referred to herein as unitary.

What is claimed is:

1. A folded antenna for radio waves comprising a peripheral ring support, a flexible non-woven preformed mesh member having dimensional stability secured to said support, said mesh member comprising criss-crossing flexible fibers of negligible extensibility having a modulus of elasticity and yield strength sufficient for providing the negligible extensibility, each of said fibers integrally bonded to said ring support.

2. An antenna as in claim 1 wherein said mesh member is electrically conductive.

3. An antenna as in claim 1 wherein said fibers are metal-coated glassy fibers.

4. An antenna as in claim 3 wherein said glassy fibers are quartz.

5. A folded antenna for radio waves comprising a peripheral ring support, a flexible preformed antenna mesh member secured to said support, said mesh member comprising intersecting fibers having a modulus of elasticity exceeding $10 \times 10^6$ psi and a yield strength exceeding $32 \times 10^3$ psi sufficient for maintaining negligible extensibility of the fibers, with fibers extending in a common direction lying in a common surface touching and lying parallel with the surface in which fibers extending in directions other than said common direction lie, each of said fibers integrally bonded to said ring support.

6. The invention according to claim 5 wherein said fibers are quartz.

7. The invention according to claim 5 wherein intersecting fibers are bonded to each other at their intersections.

8. A folded antenna as in claim 5 wherein said fibers are formed of non-woven fibers.

9. The invention according to claim 5 wherein said fibers comprise a metal aluminum coating fibers of quartz.

10. A folded antenna as in claim 5 wherein said preformed unitary flexible mesh member is shaped as a parabola.

* * * * *